US011872438B2

(12) United States Patent
Hubble et al.

(10) Patent No.: US 11,872,438 B2
(45) Date of Patent: Jan. 16, 2024

(54) EXERCISE DEVICE INCORPORATING GYROSCOPIC INITIATED DYNAMIC RESISTANCE

(71) Applicants: John Hubble, Chiang Mai (TH); Steven Christopher Polaski, Chiang Mai (TH)

(72) Inventors: John Hubble, Chiang Mai (TH); Steven Christopher Polaski, Chiang Mai (TH)

( * ) Notice: Subject to any disclaimer, the term of this patent is extended or adjusted under 35 U.S.C. 154(b) by 191 days.

(21) Appl. No.: 17/230,918

(22) Filed: Apr. 14, 2021

(65) Prior Publication Data

US 2022/0331645 A1 Oct. 20, 2022

(51) Int. Cl.

| | |
|---|---|
| ***A63B 21/22*** | (2006.01) |
| ***A63B 24/00*** | (2006.01) |
| ***A63B 21/005*** | (2006.01) |
| ***A63B 21/00*** | (2006.01) |

(52) U.S. Cl.

CPC ..... *A63B 21/222* (2015.10); *A63B 21/0004* (2013.01); *A63B 21/0058* (2013.01); *A63B 21/4035* (2015.10); *A63B 24/0087* (2013.01); *A63B 2220/89* (2013.01); *A63B 2225/50* (2013.01)

(58) Field of Classification Search

CPC ..... A63B 21/222; A63B 21/4035; A63B 21/0004; A63B 21/0058; A63B 24/0087; A63B 2220/89; A63B 2225/50

See application file for complete search history.

(56) References Cited

U.S. PATENT DOCUMENTS

| | | | |
|---|---|---|---|
| 3,977,676 | A | 8/1976 | Geisselbrecht |
| 4,277,912 | A | 7/1981 | Hsien |
| 4,625,961 | A | 12/1986 | Brand |
| 5,439,408 | A | 8/1995 | Wilkinson |
| 5,542,672 | A | 8/1996 | Meredith |
| 5,580,338 | A | 12/1996 | Scelta et al. |
| 5,683,284 | A | 11/1997 | Christen |

(Continued)

FOREIGN PATENT DOCUMENTS

| | | | | |
|---|---|---|---|---|
| WO | WO-0261372 | A1 * | 8/2002 | ..... G01C 19/02 |
| WO | WO-02061372 | A1 * | 8/2002 | ..... A63B 21/00069 |

*Primary Examiner* — Sundhara M Ganesan
*Assistant Examiner* — Jacqueline N L Loberiza

(57) ABSTRACT

A portable, handheld exercise device comprises a spherical outer shell with multiple parallel handles mounted to the outer surface thereof containing a rotating mass therein. An inner shell located within is spaced from but attached to the outer shell. A gyroscopic energy-generating structure (GEGS) is located within the inner shell. The GEGS comprises a rotating disc or a rotating mass configured to simulate a rotating disc. The rotating disc or a rotating mass is powered to spin around a rotational axis orientated in a preselected orientation to the multiple parallel handles. When the one or more handles of the exercise device are held by an individual the spinning characteristics of the rotating disc or mass creates a force against the user's hands. An internal or external controller allows the user to vary the spinning characteristics of the spinning mass and the level and intensity of the resultant exercise provided to the user in counteracting the forces created. Multiple embodiments of the GEGS are provided.

13 Claims, 16 Drawing Sheets

(56) References Cited

U.S. PATENT DOCUMENTS

| | | | | |
|---|---|---|---|---|
| 6,030,272 | A | 2/2000 | Hu | |
| 6,458,008 | B1 * | 10/2002 | Hyneman | A63H 1/00 446/259 |
| 6,740,014 | B2 | 5/2004 | Tsai | |
| 7,383,747 | B2 * | 6/2008 | Tippett | F03G 3/00 74/5.22 |
| 7,686,740 | B1 | 3/2010 | Chang | |
| 7,935,035 | B2 * | 5/2011 | Smith | A63B 21/22 482/44 |
| 7,942,793 | B2 | 5/2011 | Mills et al. | |
| 7,955,239 | B2 | 6/2011 | Wojtkiw et al. | |
| 8,784,269 | B2 | 7/2014 | Wright | |
| 2003/0060331 | A1 | 3/2003 | Polk, III et al. | |
| 2007/0225121 | A1 | 9/2007 | Olason et al. | |
| 2008/0312052 | A1 | 12/2008 | Krietzman | |
| 2009/0197499 | A1 | 8/2009 | Davis | |

* cited by examiner

EXERCISE DEVICE INCORPORATING GYROSCOPIC INITIATED DYNAMIC RESISTANCE

BACKGROUND

Exercise equipment provides different methods of engaging the user, primarily through resistance (weights, universal gym, and the like) and positioning (Pilates tables, bars, and boards and the like). Resistance is currently provided by static devices, devices that remain fixed in weight or orientation, such as weights, elastic bands, springs, friction devices, and the like.

A disadvantage of current exercise equipment is the lack of dynamic resistance engagement and force vectoring application. For example, a standard universal gym exercise trains muscles through one motion, never changing the resistance through the exercise and never reacting to the speed of the user's movement.

Humans are uniquely adapted though training to react to moving static weights through counter movement. A static weight such as a dumbbell, is a weight that does not change resistance or resistance orientation through its movement. The only force acting upon it is gravity and the orientation of gravity does not change so the dumbbell can be considered a static weight. When a user exercises with static weight, they are controlling the mass of the dumbbell which is under a constant gravitational pull. Using exercise machines, the orientation of resistance is changed but still remains static. In order to change the orientation of resistance the equipment used usually increases in size, which is another disadvantage.

A further disadvantage to these types of equipment is that they usually employ a single movement, which tends to over develop certain muscle groups while leaving other muscles underdeveloped. Prolonged use of single exercises without change will lead to muscularity uses that hinder normal performance and may lead to repetitive motion injury.

An alternative to a static device is shown in U.S. Pat. No. 8,784,269 to Ken Wright which discloses a hand-held exercise device using gyroscopic or centrifugal forces to provide resistance to movement in a defined direction. In particular, the patent discloses a handheld device with an internal flywheel spinning around a central axis fixed in regard to the frame of the device, the device having a single handle. The flywheel rotates at a desired speed and provides a gyroscopic resistance to movement in a direction relative to the orientation of the axis in the device. While the weight of the flywheel and the speed may be increased or decreased to further adjust the resistance caused by the rotating flywheel, the orientation of the axis is fixed in regard to the frame of the device and the orientation of the single handle and is not adjustable. By holding the device in a particular orientation and attempting to move the device against the gyroscopic effect, resistance is provided for exercising, the resistance existing when the device is moved from a stationary position. However, no resistance is provided if the device is not moved against the gyroscopic resistance which is fixed in a particular direction. A controller on the devices allows the speed of rotation of the flywheel around the fixed axis to be adjusted which in turn increases or decreases resistance during exercise movement in a particular direction, providing a workout that is generally not possible using current exercise equipment.

Haptic technology, also known as kinesthetic communication or 3D touch, refers to any technology that can create a tactile experience or transmit information by applying forces, vibrations, or motions to a user of a device. The term "haptics" also relates to the use of tactile sensations provided by the interface on an object or device, those tactile sensations transmitting information regarding use or operation of the object or device to a user of the device through the sense of touch. For example, a simple form of haptic technology is the vibration mode in a smartphone that alerts a user to incoming messages and other notifications.

SUMMARY

The exercise device and system described herein provides an exercise device which provides resistance to movement in any direction provided by one or more of gyroscopic forces generated by the device. The exercise device can also function as a haptic device as the changing forces generated by the device are felt by the user. In one embodiment, a multiple handle handheld device includes an internal flywheel or rotating mass. The flywheel is initially spun up to a desired speed to provide a gyroscopic resistance to movement in a particular direction relative to the orientation of the device. By holding the device in a particular orientation and attempting to move the device against the gyroscopic effect, resistance is provided for exercising and that resistance is felt by the user, thus training the user to develop different parts of the user's body. By changing the speed of rotation an increase or decrease of resistance is provided. Also, by changing the internal orientation of the flywheel relative to the outer shell of the device vector resistance is sensed by the user.

In the various embodiments, the rate of rotation of the flywheel can be controlled via an on-board controller and/or an external controller so that the resistance can be increased or decreased during exercise movement, thus incorporating a real-time positional/orientation device. Resistance can be changed and repositioned by changing the internal orientation of the flywheel and/or rotation of the internal mass so as to vary the user response to real or virtual information and/or grasping the device by a different handle. The variations of the exercise system described herein provides a device where dynamic resistance engagement and force vectoring is provided by gyroscopic forces.

In the embodiments, a uniform mass is rotated at a desired speed to provide gyroscopic resistance to movement. Holding the device in a specific orientation and moving it in a particular direction provides resistance, the faster the mass is rotated the more resistance is provided. The device resists change in orientation that would result in a change in angular momentum. With any given movement of the device in comparison to the same movement of static weight, the user experiences a greater muscle activation due primarily to the difficulty in stabilizing a rotating mass through a movement that changes its angular momentum. By changing the angular position of the axis of the spinning disk you can create an impulse of angular momentum which will be realized as a real force acting on the device (and subsequently anyone holding it).

By modulating the speed of the spinning disk in the device, haptic communication is created such as communicating to the user the time remaining in an exercise routine. When the device is used in combination with a virtual reality environment the speed of the disk can be changed as the user passes through different VR simulations, doors, levels, floors, etc., thus communicating information based on changes in the virtual environment.

In certain embodiments the rotation speed and internal orientation of the rotational axis can be changed during an exercise movement. This can be set in several alternative modes such as, but not limited to, a follow movement mode, a complete resistance mode or an angular movement mode. A controller is used to control the rotation speed and internal orientation of the rotating mass while getting feedback from a positional/orientation device. This also allows the user to experience dynamic resistance engagement and force vectoring based on the position of the device relative to the user and provides engagement of muscularity that is impossible using current exercise equipment.

The controller can also be wirelessly connected to other devices that have internet connectivity. This provides the user with exercise data specific to their history using the device. All of the data can be stored on external data storage devices such as data sticks or cloud-based memory so it is accessible while not using the device. Examples of data that can be acquired and analyzed are exercise frequency, intensity and positional orientation.

In another embodiment of the device the user is provided a haptic experience via an audio visual or virtual reality environment. A particularly unique benefit is that the device provides exercise and force feedback in a system that is not required to be connected to a larger stationary mass or device.

DETAILED DESCRIPTION

The exercise system provides a light-weight, portable, handheld device containing a rotating mass that is activated by the user. The rotating mass applies forces in various directions against a user holding the device. The system provides for controlled rotation of the mass and in the second and third embodiments controlled rotation of the mass as well as controlled changes to the orientation of the axis of rotation of the mass within the external surrounding shell of the device. Thus the forces applied to the user holding the device are varied by controlling the rotational speed, the rotational direction and the axis of orientation. The external surface of the device includes several handles for users to grasp the device and can also include rings to mount straps or elastic bands, which add to the range of resistance that the device can provide. The system also provides dynamic engagement, haptic interfacing and user sensed tactile information as a result of the internal rotating mass.

Figure 1:
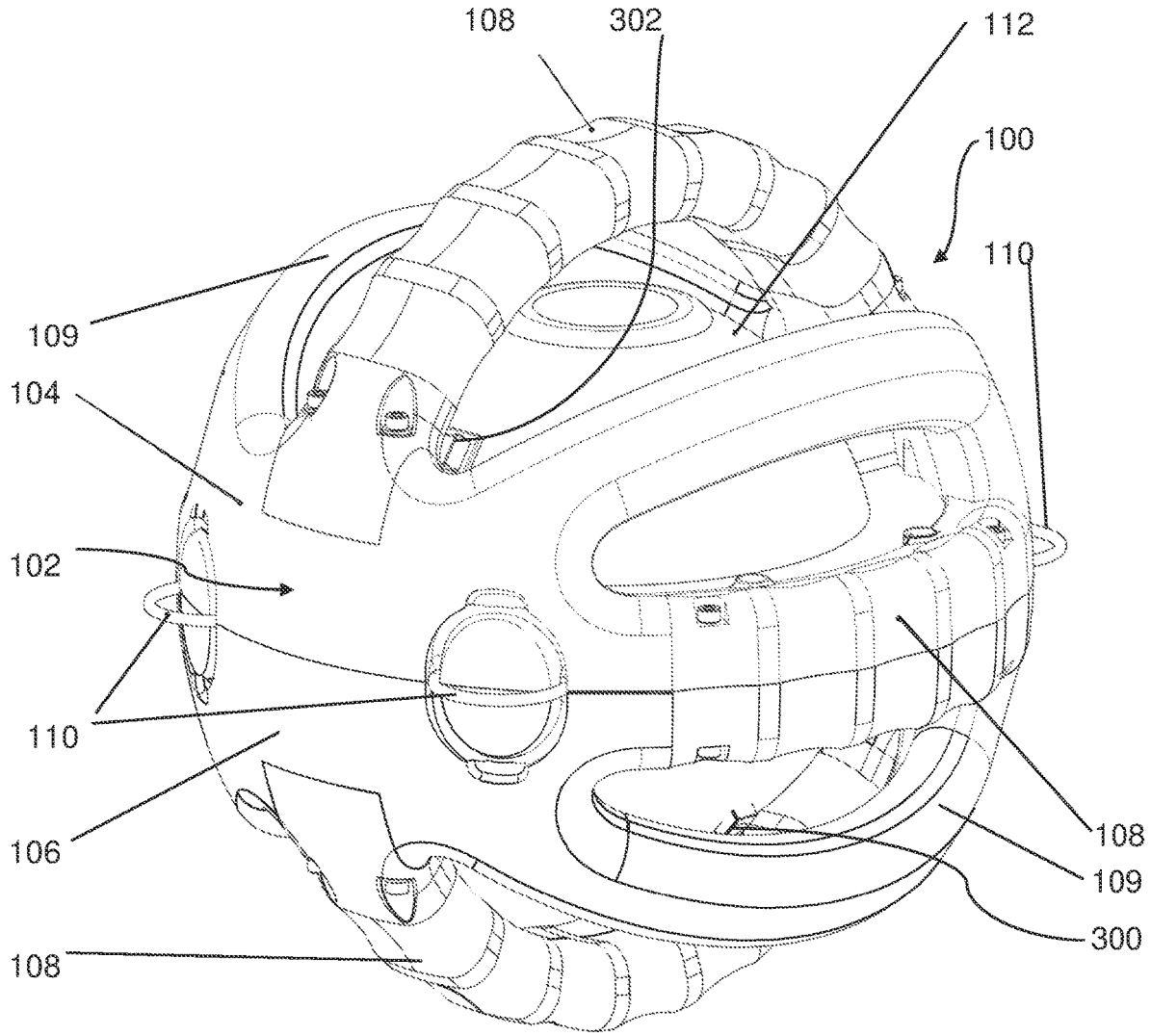
FIG. 1 is a front perspective view of a hand-held exercise system incorporating features of the invention.

A first embodiment of the system incorporating features of the invention is shown in FIG. 1. The device 100 has an outer shell 102 that comprises two substantially identical components (upper and lower portions 104 and 106) and two pairs of parallel handles 108 (three handles are shown in FIG. 1) that are removable and replaceable along with 4 additional parallel fixed handles 109. Four D-Rings 110 are provided for attachment of straps or elastic bands (not shown) that can be connected to the D-rings to increase the resistance range of the device. An inner shell 112 protects the internal electronics and structure of the device.

Figure 2:
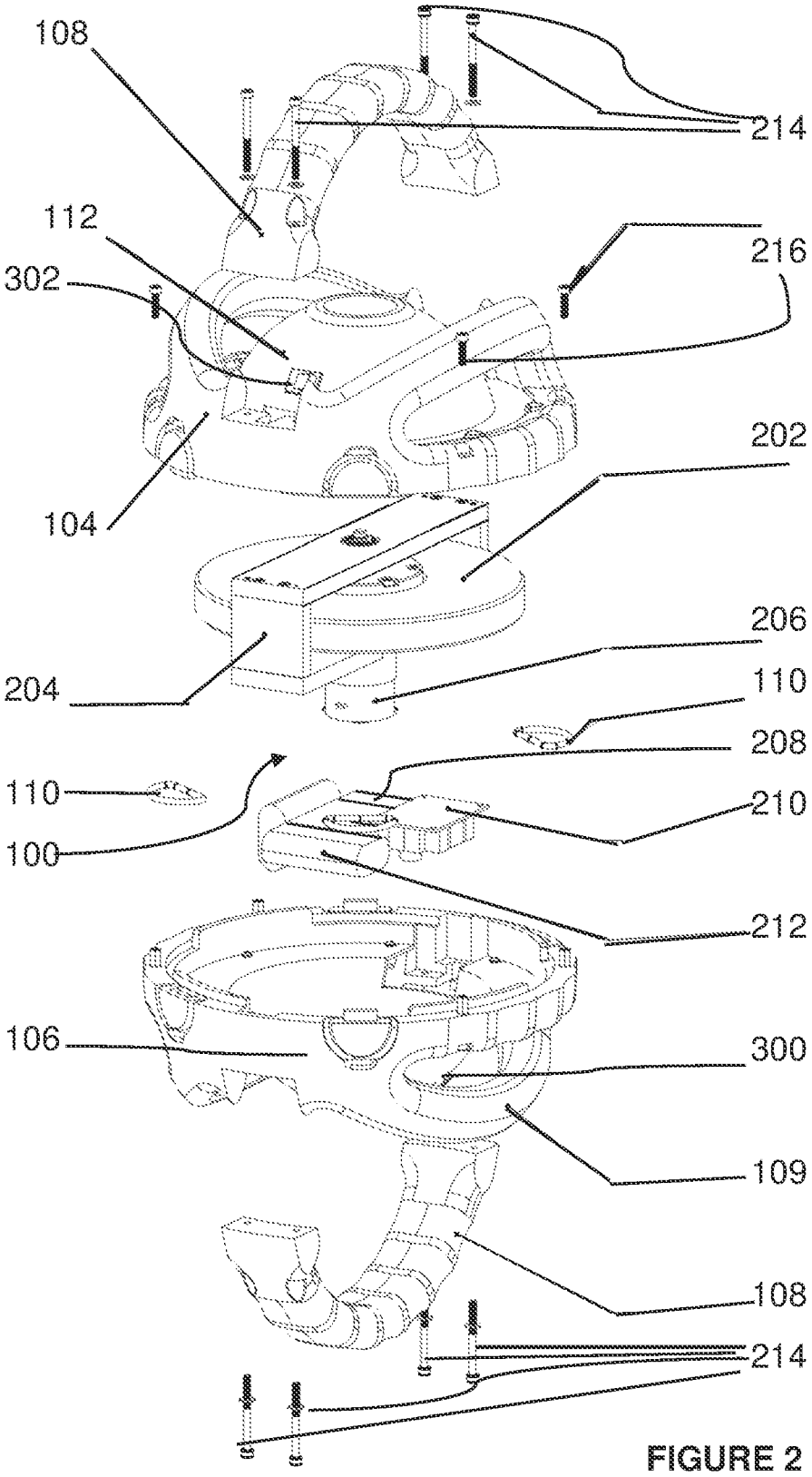
FIG. 2 is an exploded view of a first embodiment of the hand-held exercise system of FIG. 1.

FIG. 2 is an expanded view of the exercise device 100 shown in FIG. 1. Components located in the inner shell 112 comprise a rotating mass 202, referred to alternatively as a flywheel, located within a stabilizing structure 204, and a drive motor 206 mounted below the stabilizing structure 204, the drive motor 206 connected to the rotating mass 202 by a shaft (not shown). The drive motor 206 is positioned in a receiver 208 in the controller/charger/positional tracker component 210. One or more batteries 212, preferably rechargeable, are electrically connected to the drive motor 206 which is mounted on the controller/charger/positional tracker component 210.

One of the pairs of handles 108 are attached to the stabilizing structure 204 with the handle screws 214. The handle screws 214 also pass through and firmly attach the outer shell 102 to the stabilizing structure 204. This firm attachment of the components is an important aspect of the design; a stabilizing structure is required to ensure the robustness of the design due to the high gyroscopic forces created by the rotating mass 202. Also, because unsupported motors cannot handle the forces created by the changes in angular momentum of the device, the stabilizing structure 204 is required.

The controller/charger/positional tracker 210 controls the speed of the motor and balances the delivery of power from the one or more batteries 212. The controller/charger/positional tracker 210 can also include wireless connectivity to allow connection to external devices. For example, see a wireless controller 220 shown in FIG. 5. This allows exercise data and device operational data to be uploaded to the external devices and/or the cloud for analysis of the user's exercise regime using external wireless communication.

The D-Rings 110 are firmly attached to the outer shell 102 while allowing them to rotate slightly to adjust to the position of any straps or elastic bands when are attached to the exercise device 100. The upper and lower portions 104 and 106 of the outer shell 102 are secured together using housing screws 216. The stabilizing structure 204 secured within the outer shell 102 helps to maintain the rigidity of the exercise device 100. The removeable handles 108 allow for easy replacement by the user providing the ability to easily change the grip style or add other attachments to the exercise device 100.

Figure 3:
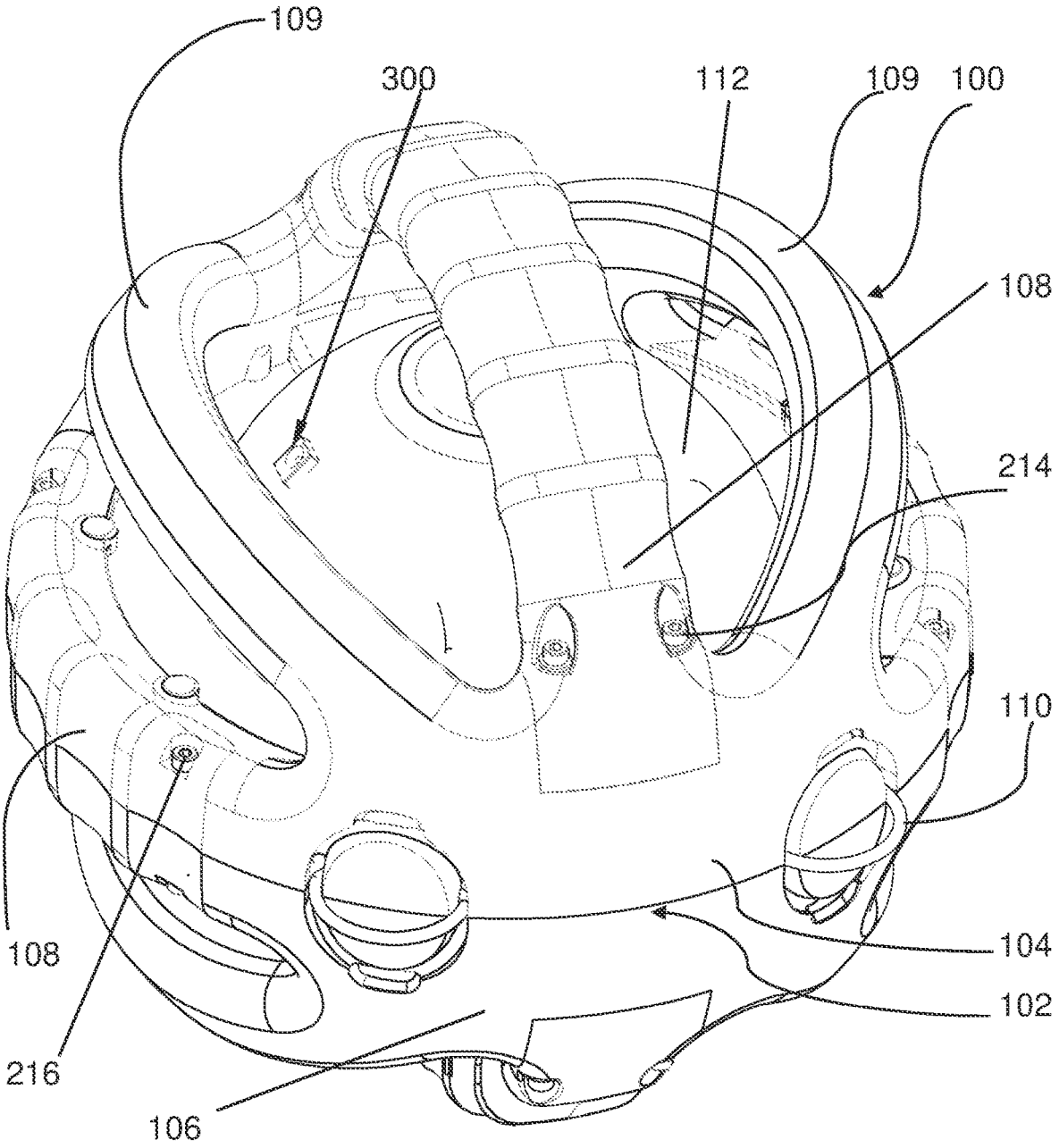
FIGS. 3 and 4 are additional perspective views of the first embodiment of the hand-held exercise system of FIG. 1 rotated so that additional features of the system, such as the location a power switch and power supply jack, can be viewed.
Figure 4:
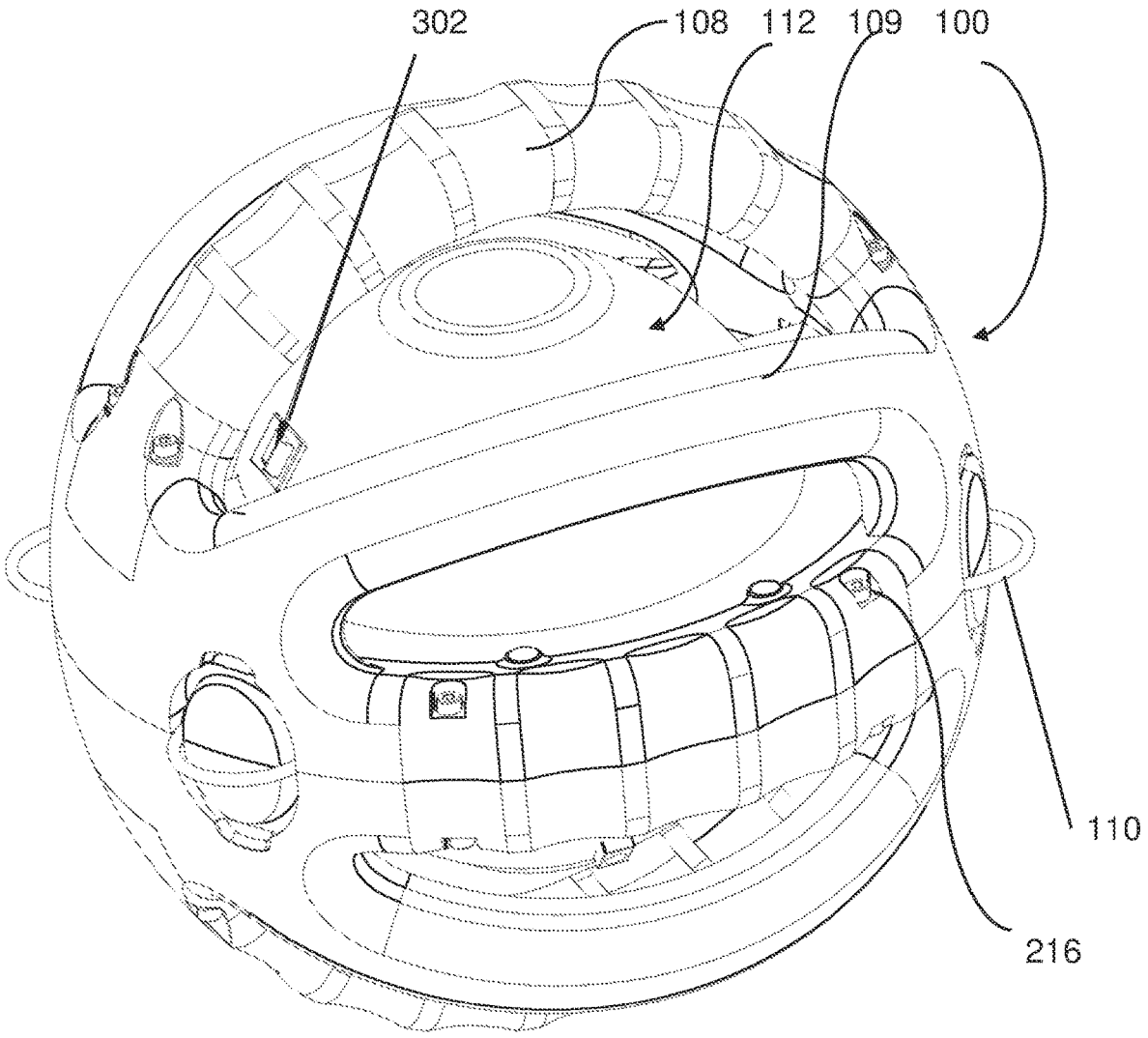

FIGS. 3 and 4 are alternate views of the exercise device 100 shown in FIG. 1. FIG. 3 shows the location of the power supply jack 300 for connecting to an external power source to charge the batteries 212. FIG. 4 shows the location of the power switch 302 for use to turn the exercise device 100 on and off.

Figure 5:
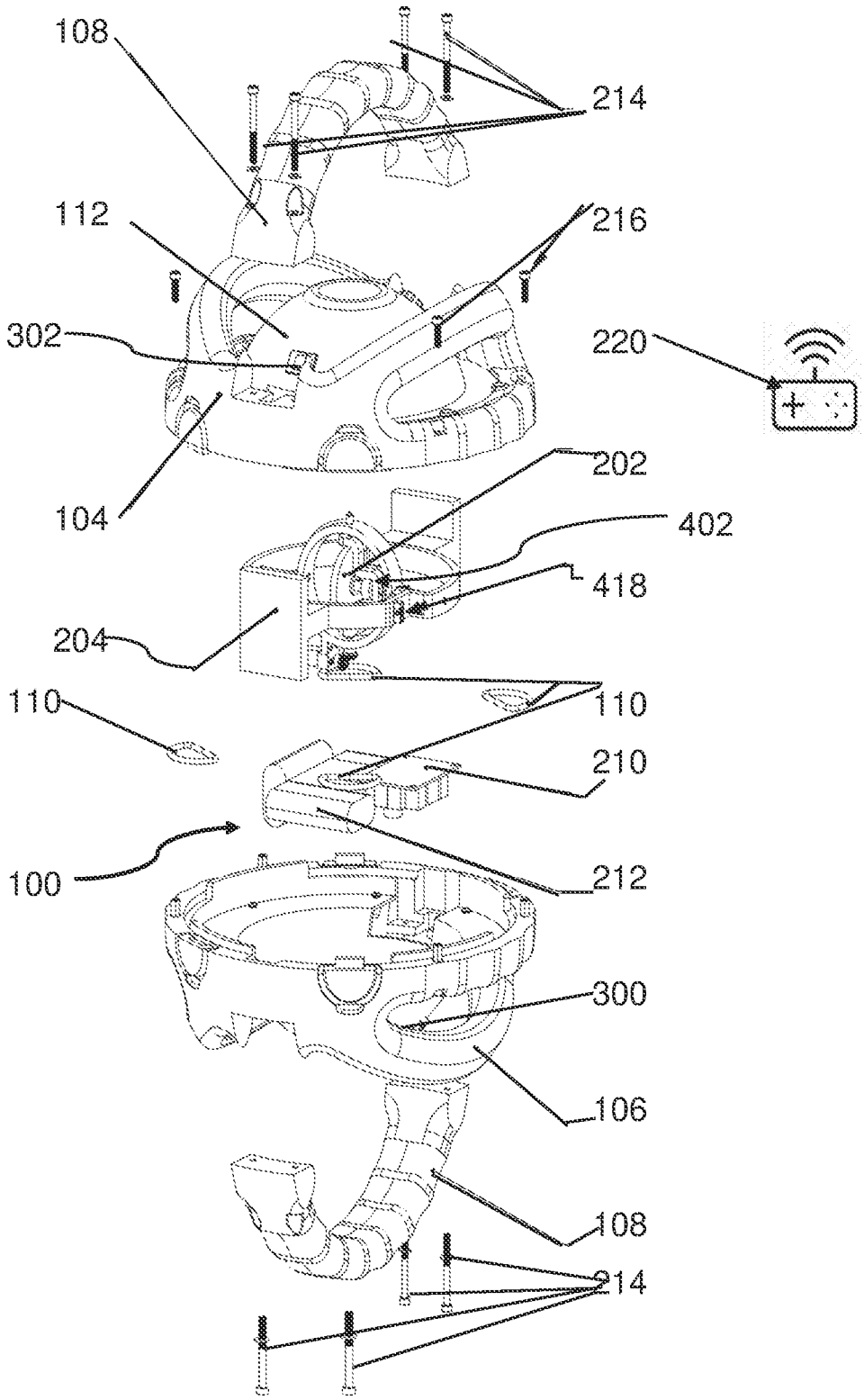
FIG. 5 is an exploded view of a second embodiment of the hand-held exercise system of FIG. 1.
Figure 6:
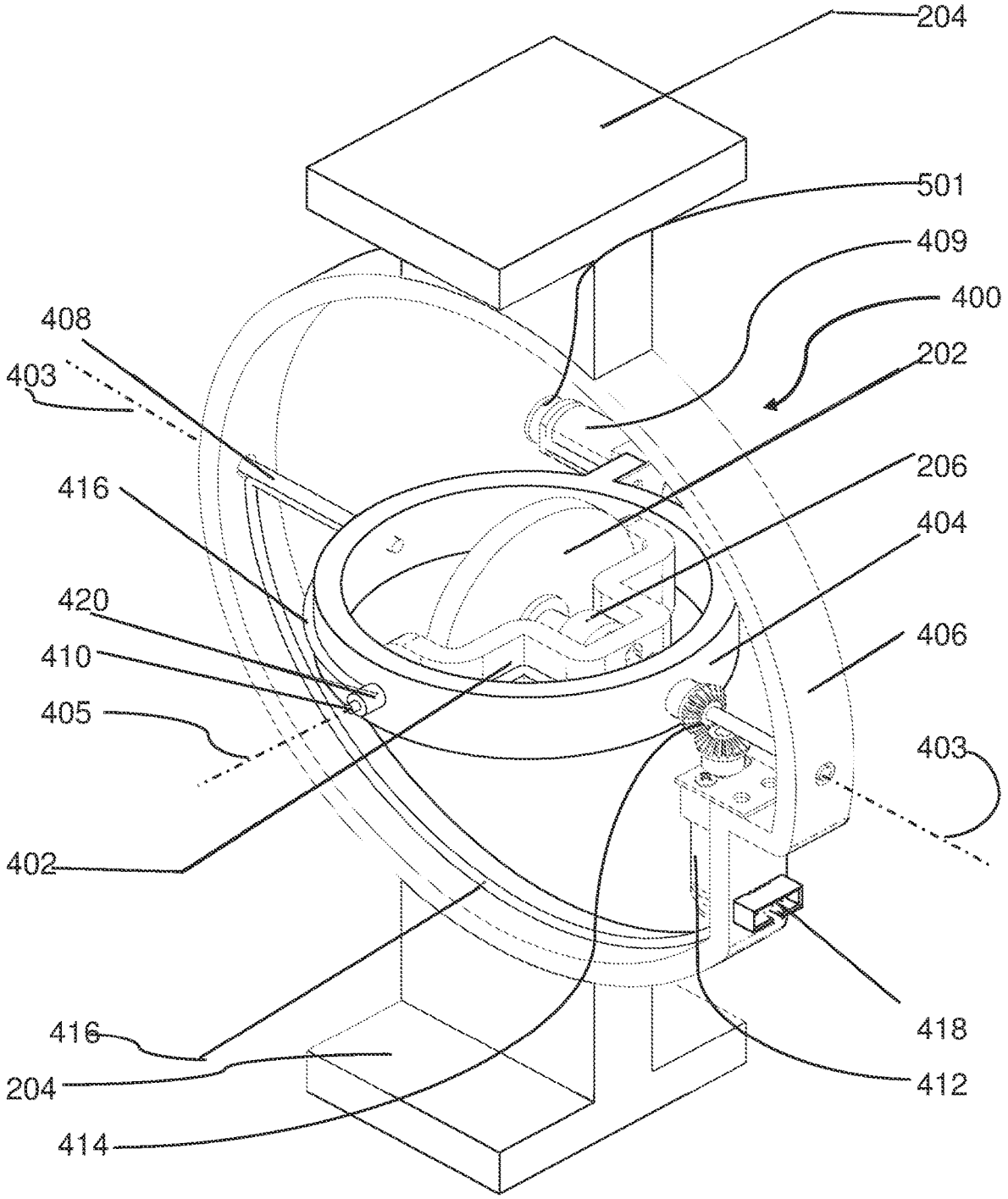
FIG. 6 is a perspective view of the internal structure of the embodiment of FIG. 5, showing a motorized gyroscope within the structure.

FIGS. 5 through 9 show another embodiment of the internal components of the exercise device 100 incorporating a multiple ring gyroscopic assembly 400 for stabilizing the exercise device 100 during operation. FIG. 6 is an expanded view which shows the internal gyroscopic assembly 218 positioned within the central portion of the exercise device 100 in place of the flywheel 202 assembly shown in FIG. 2. FIG. 5 also shows an alternative external controller 220 which allows wireless communication with the various internal components of the exercise device 100.

The multiple ring assembly best shown in FIG. 6 comprises a middle ring 404 within an external (outer) ring 406, with the middle ring 404 attached by an outer shaft 408 to the external ring 406, the middle ring 404 configured to rotate within the outer ring 406 around the outer axis 403 of external (outer) shaft 408. The flywheel 202 is caused to rotate by the drive motor 206 which is mounted in an internal bracket 402 that stabilizes the rotating flywheel 202. The drive motor 206 is positioned in the internal bracket 402 which is in turn mounted within the middle ring 404 by a middle ring shaft 410, the internal bracket 402 along with the flywheel 202 being configured to rotate within the middle ring 404 around the middle ring axis 405 through the middle ring shaft 410. An internal bracket motor 409 mounted on the middle ring 404 rotates the internal bracket 402 relative to the middle ring 404 by use of paired gears 414 (see FIG. 8). A middle ring motor 412 functions to rotate the middle ring 404 around the axis 403 of the outer shaft 408 by way of paired gears 414. Power, and controller instructions to the internal rotating components, are transmitted from the internal controller 210 through a connector 418, conductive slip rings 420 and wires 416 attached to the rings 404. Slip rings are used for each axis of rotation (outer axis 403 and the middle ring axis 405).

Figure 7:
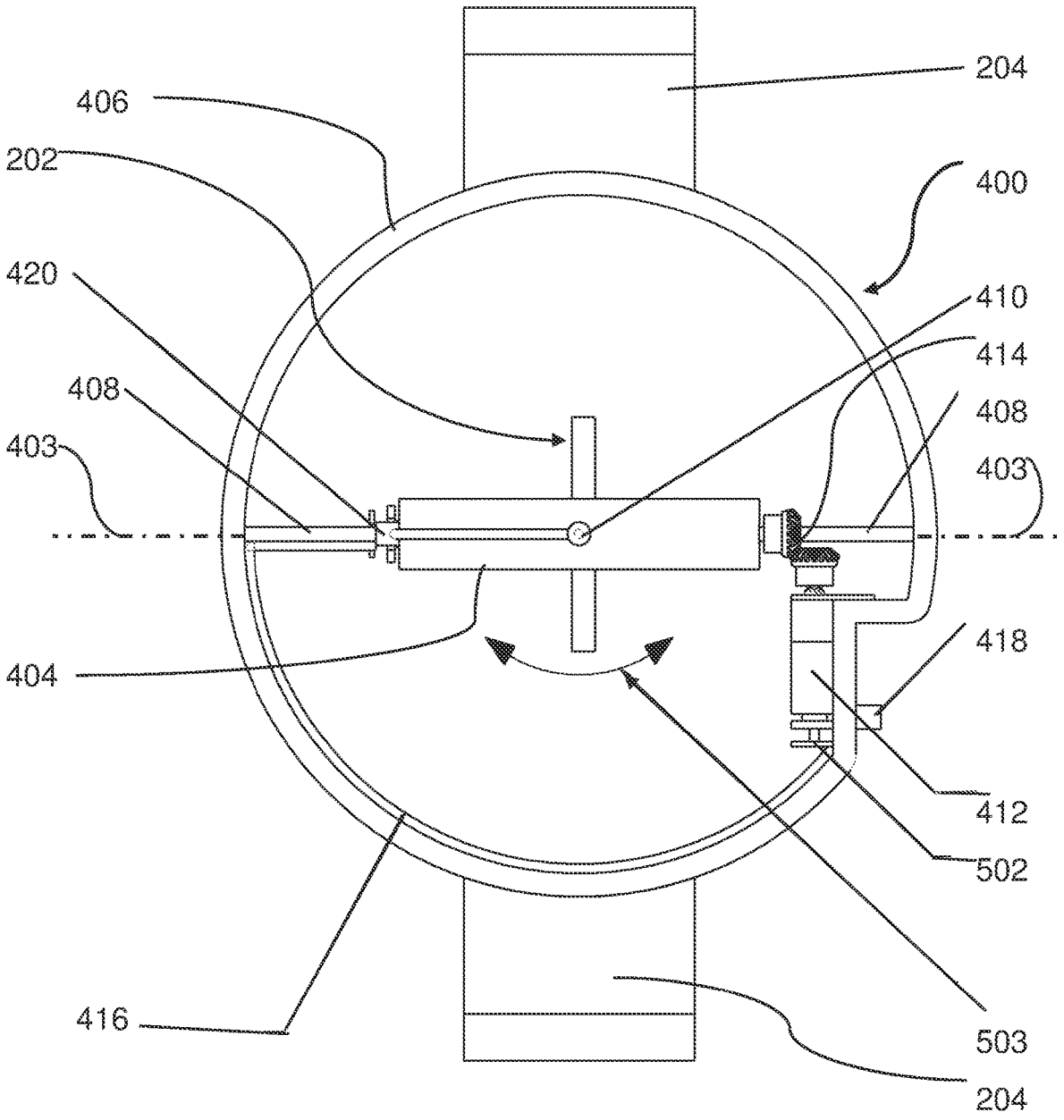
FIG. 7 is a side view of the internal structure of the system shown in FIG. 5.

FIGS. 6 and 7 also show a stabilizing structure 204 used to mount the internal gyroscopic assembly 218 to the outer shell 102. The stabilizing structure 204 is attached to the outer ring 406, allowing mounting of the internal gyroscopic assembly 218 into the outer shell 102. The controller 210 internal to the shell is in communication by the wire 416 with the connector 418 on the outer ring 406. Due to the complex operation modes of this embodiment an external wireless controller 220 is used to deliver instructions to the operating components within the exercise device 100. The middle ring motor 412 and internal bracket motor 409 rotate the middle ring 404 and internal bracket 402 respectively allowing the flywheel 202 to dynamically change its axis of rotation, thereby creating a perceived force vector. Electrical signals travel through the wiring 416 to the motors 412, 409, 206 through a slip ring 420 on the middle ring 404 to another slip ring 420 on the outer ring 406, through the wire 416 to the motors 409, 412 and encoders 501, 502 and to the drive motors 206. A slip ring is an electromechanical device that allows the transmission of power and electrical signals from a stationary to a rotating structure. These slip rings 420 allow transmission of power and electrical signals from a stationary to a rotating structure. The wiring 416 then follows the curve of the outer ring 406 to the middle ring motor 409 and to the internal bracket 402 and the drive motor 206. All the motors 412, 409, 206 and encoders 501, 5502 and signal wires 416 are wired to the connecter 418 that is then connected to the internal controller 210.

The arrows 503 in FIG. 7 illustrate the rotation direction of the internal bracket 402. Activation of the exercise device 100 causes the flywheel 202 to rotate generating the forces (i.e., resistance) as the mass of the flywheel 202 rotates within the stabilizing multiple ring assembly 400.

The external ring 406 holds the middle ring 404, the axis of rotation 403 allowing the external ring 406 and middle ring 404 to rotate relative to each other. The external ring 406 is fixed to the internal surface of the outer shell 102 by the stabilizing structure 204. The axis 403 is fixed to the middle ring 404 but free to rotate in the external ring 406.

Figure 8:
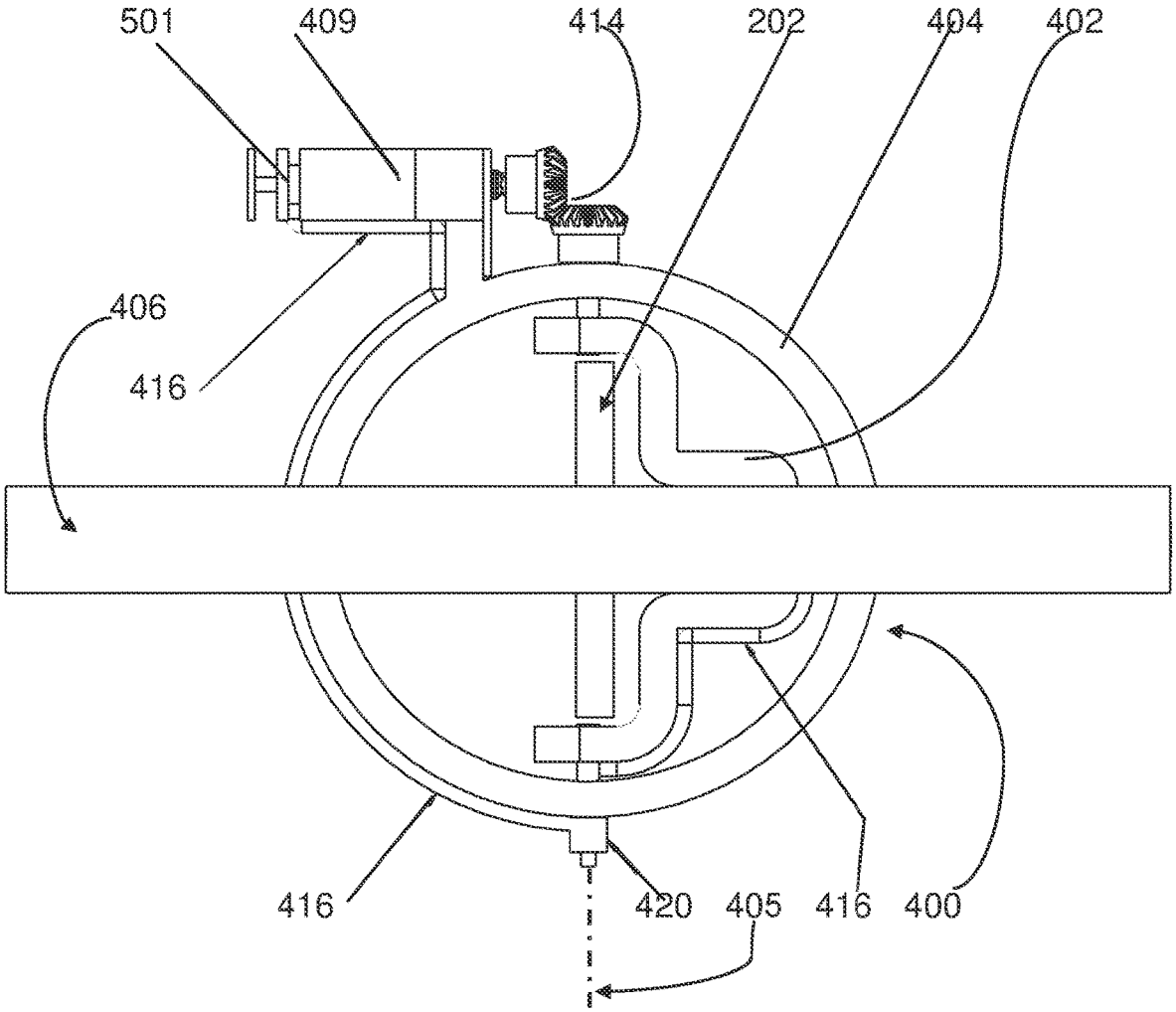
FIG. 8 is a top view of the internal structure of the system shown in FIG. 5.
Figure 9:
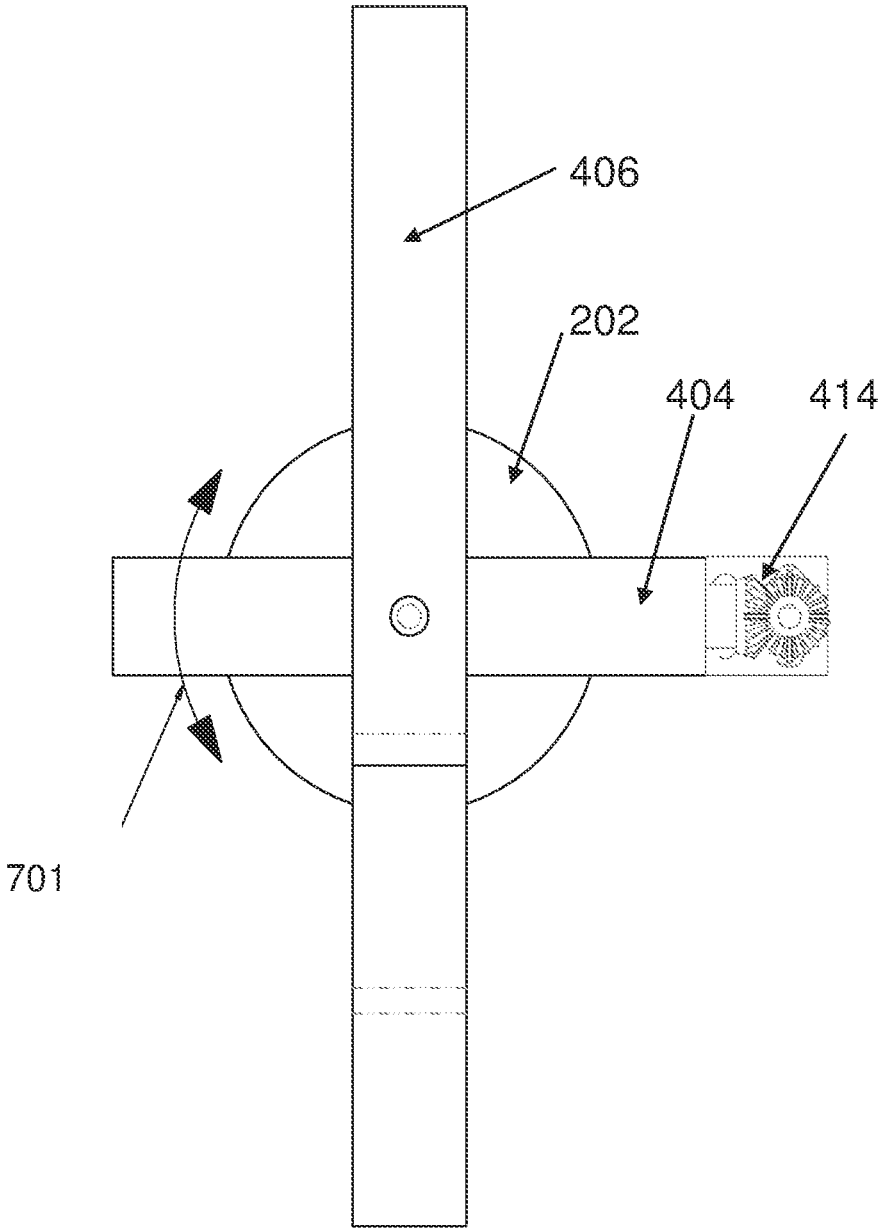
FIG. 9 is a top view, rotated 90 degrees, of the internal structure of the system shown in FIG. 5.

FIGS. 8 and 9 are additional views of the multiple ring assembly 400 with the arrows 701 in FIG. 9 illustrating the direction of rotation of the middle ring 404. The middle ring motor 412, the internal bracket motor 409, and the internal bracket motor encoder 501 respectively provide for positioning and tracking of the flywheel 202 in a wide variety of preferred orientations.

The middle ring arrows 701 in FIG. 9 illustrate the rotational direction of the middle ring 404 around the middle ring axis 405 to allow for positioning and tracking of the middle ring 404 around the outer axis 403. The ability to control and reorient rotation around the middle ring axis 405 and the outer axis 403 provides unlimited control over the spherical rotation of the rotating flywheel mass 202 and the gyroscopic forces generated by that rotation.

Figure 17:
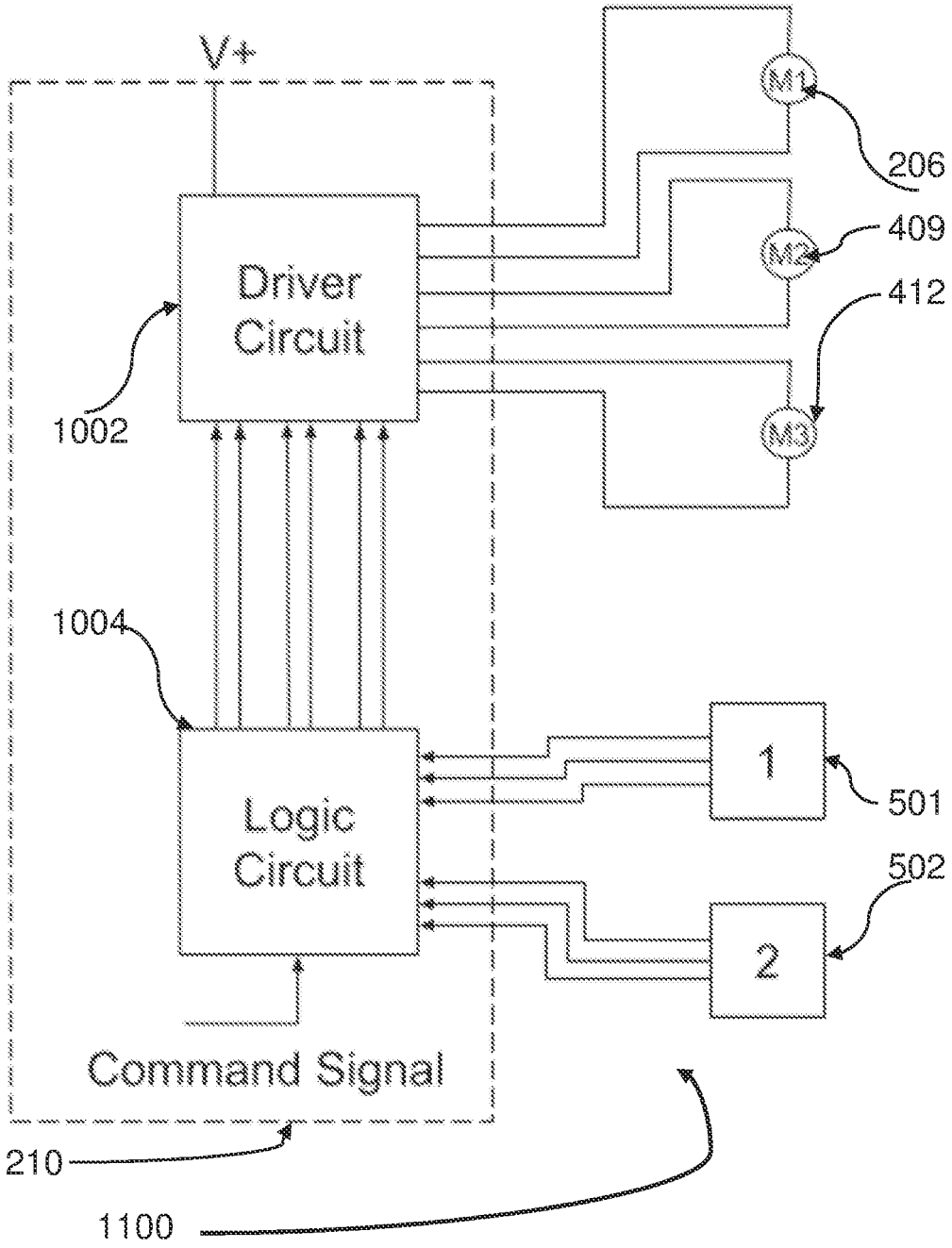
FIG. 17 is a schematic diagram illustrating an electrical arrangement for controlling the operation of the second embodiment shown in FIGS. 5-9.

FIG. 17 is a schematic diagram 1100 showing the electrical components and connections for the internal gyroscopic assembly embodiment 218 indicating the internal controller 210 which includes a driver circuit 1002 and a logic circuit 1004. The command signal is provided by the external wireless controller 220 which, in turn engages the movement of the drive motor 206 and the motors 409 and 412 based on user and/or pre-program input. The encoders 502 determine the position of the motors which are represented by the middle ring motor 412 and internal bracket motor 409 and the internal bracket motor 206 which in combination control the speed and position (orientation) of the flywheel 202.

Another embodiment using and controlling a rotating mass and the resultant gyroscopic forces incorporates a spherical magnetic array assembly 800 illustrated in FIG. 10 to FIG. 15 and described below. Primary components of the magnetic array assembly 800 are a coil array housing 802 with multiple individual coils 804 shown extending from the surface of the coil array housing 802, Hall effect sensors 806 and an internal magnetic array housing 900 (see FIG. 13). A Hall-effect sensor is a device that measures the magnitude of a magnetic field. Its output voltage is directly proportional to the magnetic field strength through it. Hall-effect sensors are used for proximity sensing, positioning, speed detection, and current sensing applications.

Figure 12:
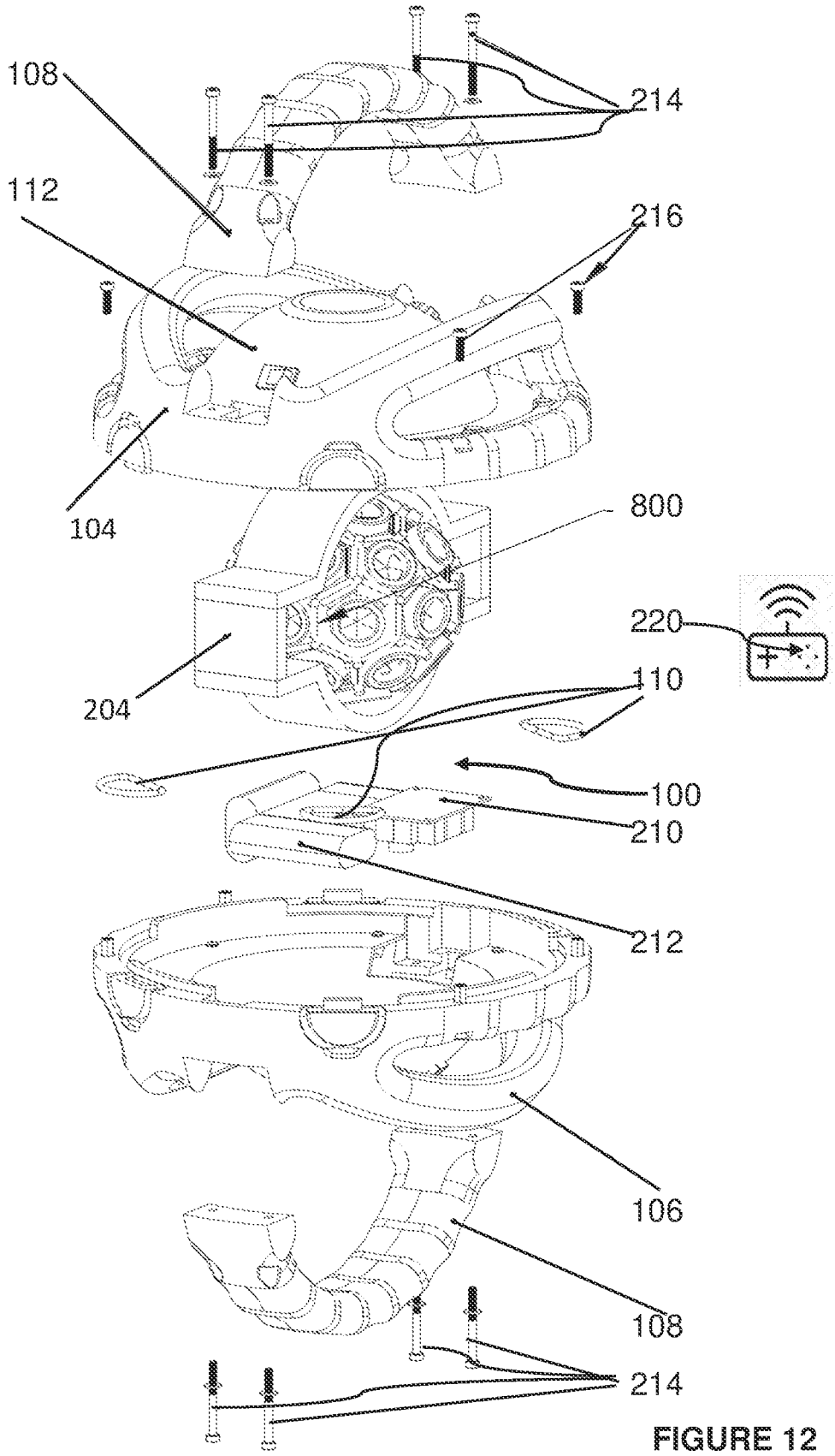
FIG. 12 is an exploded view of the third embodiment of the hand-held exercise system including the spherical magnetic array gyroscope attached to a mounting structure as shown in FIG. 11.

FIG. 12 is an expanded view showing the magnetic array assembly 800 positioned within the central portion of the exercise device 100 in place of the flywheel 202 assembly shown in FIG. 2.

Figure 10:
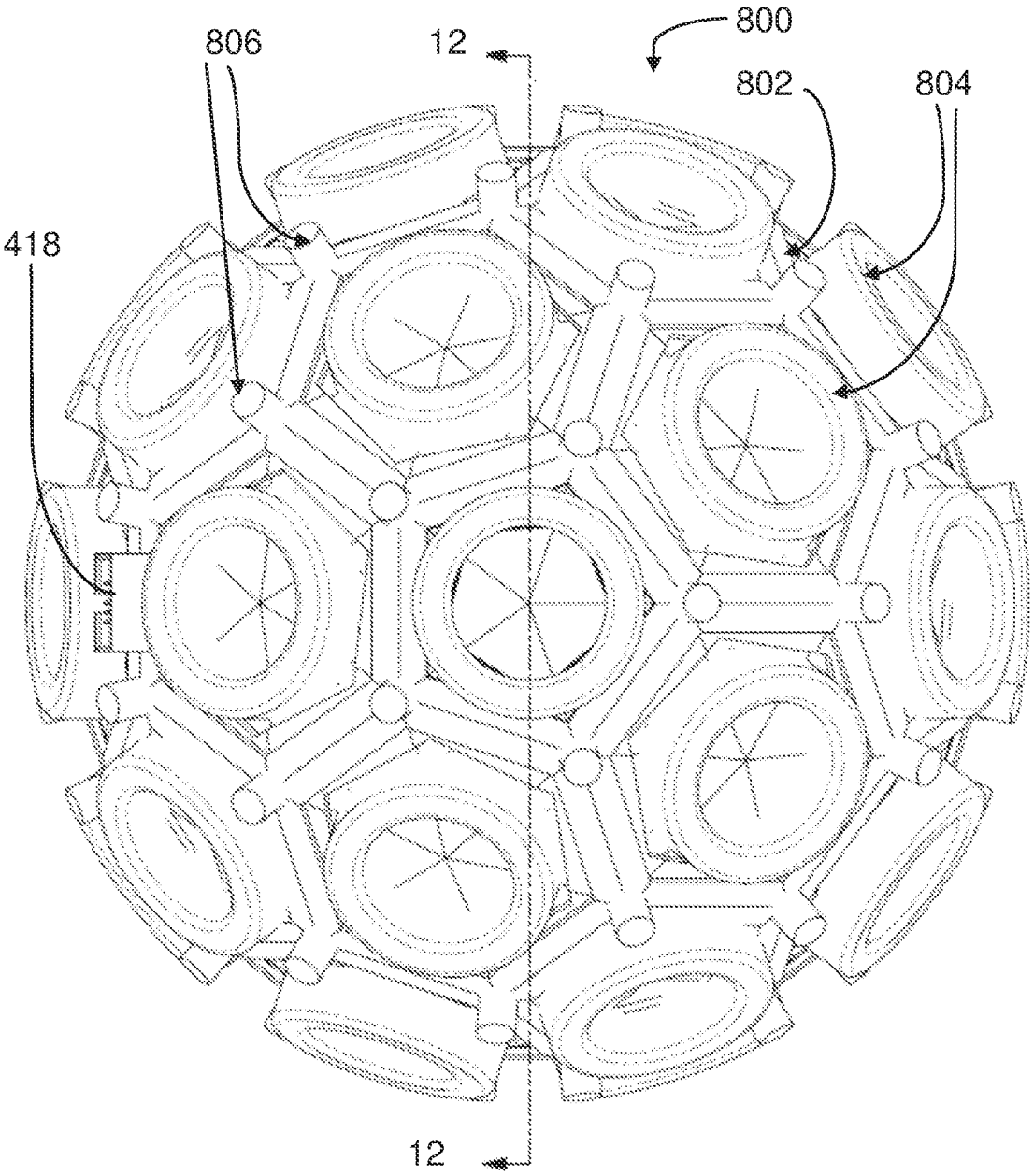
FIG. 10 is a front view of the outer surface of the internal structure of a third embodiment showing the exercise device of FIG. 1 containing a spherical magnetic array gyroscope.
Figure 13:
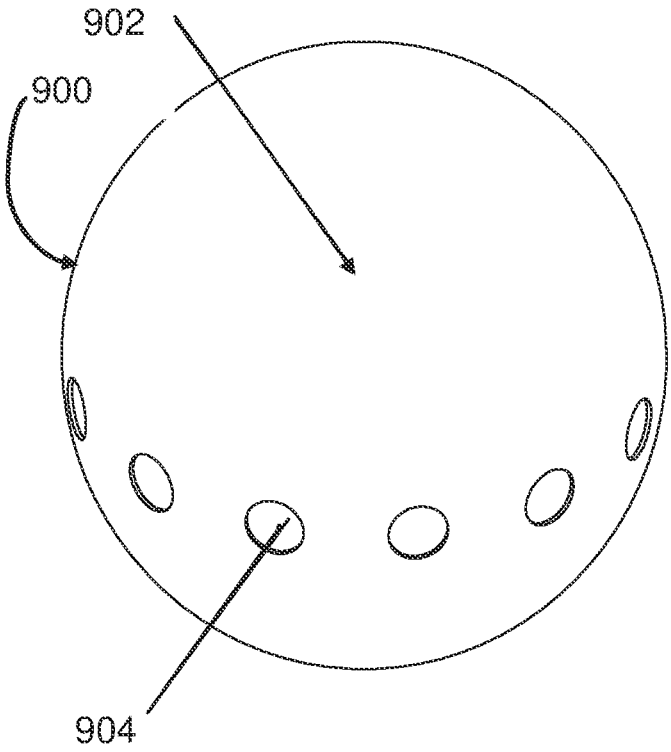
FIG. 13 is a front perspective view of the internal structure of the spherical magnetic array gyroscope of FIGS. 10-12.
Figure 14:
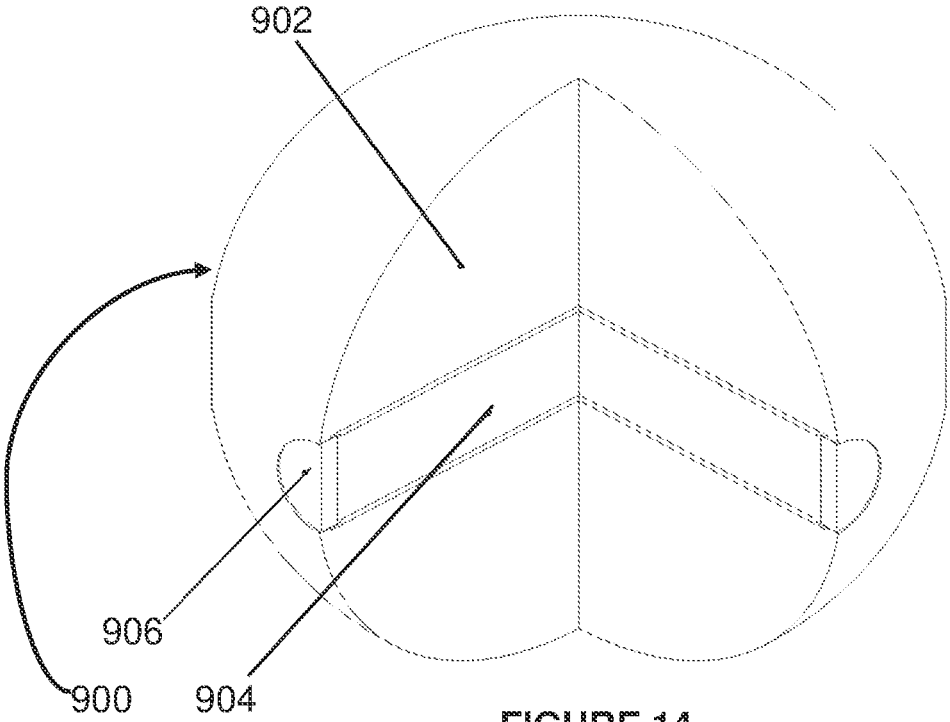
FIG. 14 is a ¼ cutaway view of the internal structure of the system shown in FIG. 13.
Figure 15:
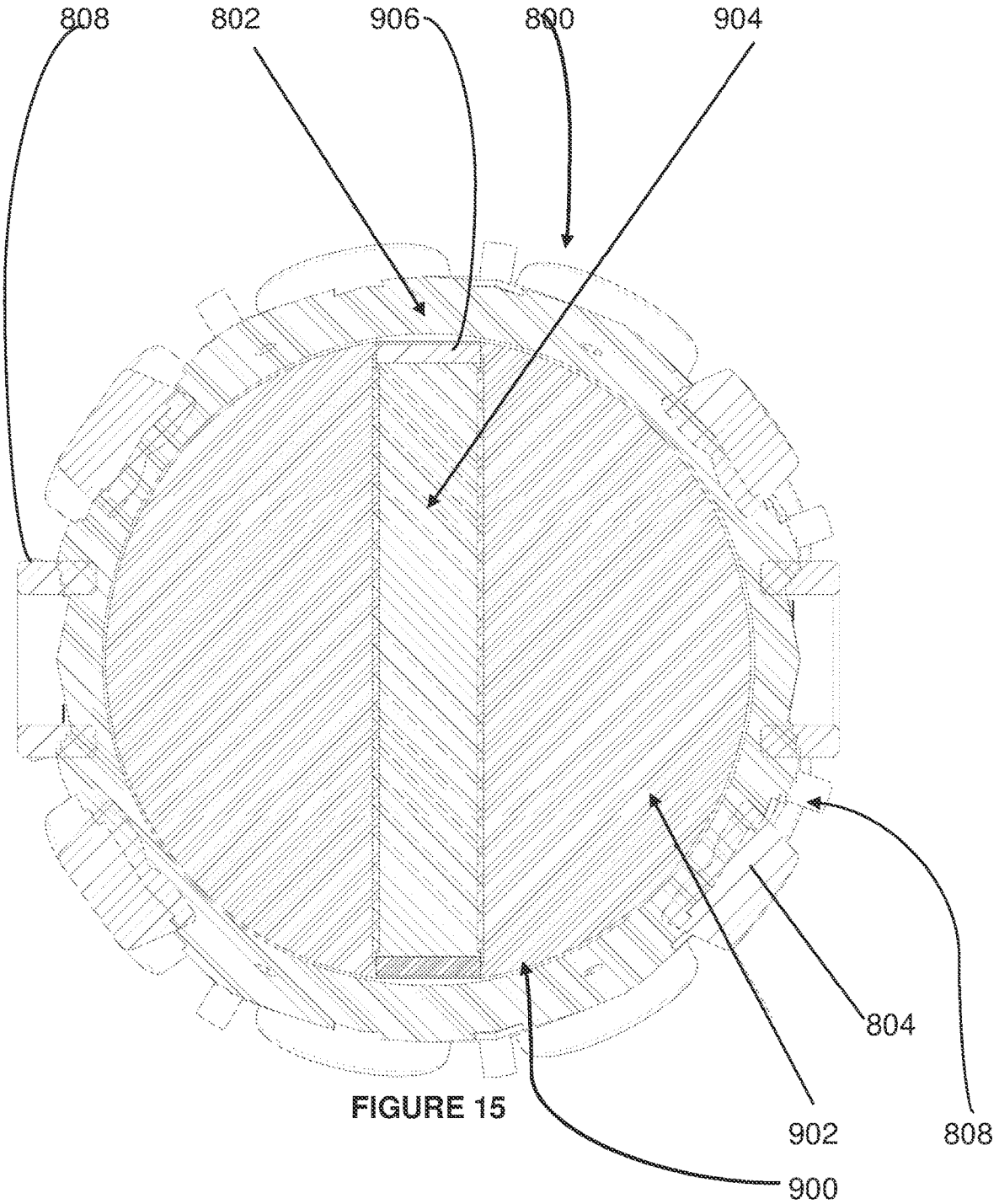
FIG. 15 is a cutaway view taken along line 12-12 of FIG. 10 showing a cross-section within the internal structure of the spherical magnetic array.

As best shown in FIGS. 13, 14 and 15, the magnetic array housing 900, located within the coil array housing 802 comprises a spherical mass 902 and an array of magnetic elements 906 in a preferred embodiment extending radially across the diameter of the spherical mass 902. The magnetic elements 906 are arrayed in a disc-like orientation around and embedded in the spherical mass 902 over a disc mass 904. FIG. 13 shows the ends of six magnetic elements 906. However, a typical arrangement will comprise at least 12 to 25 magnetic elements 906 arrayed radially from the center of the spherical mass 902. FIG. 14 is a partial cut-away view of the spherical mass 902 with the magnetic elements 906 arrayed radially from the center. FIG. 15, a cross-sectional view taken along line 12-12 of FIG. 10, shows magnetic elements 906 on the top and bottom of a disc mass 904 which extends across the diameter of the spherical mass 902. As is evident from FIGS. 13 and 14 multiple radial magnetic elements 906 can be arranged to provide alternative axis of rotation.

The spherical mass 902 has significantly less weight and density than the disc-like array of magnetic elements 906 and disc mass 904. This provides a stable rotation axis for the magnet array housing 900 which is free to rotate within the coil array housing 802. In a preferred embodiment the magnetic elements 906 in combination with the coils 804 are electromagnets so that when individual selected coils 804 are energized with an electrical current a magnetic field is generated around each of the adjacent magnetic elements 906.

In order to rotate the magnetic array housing 900 utilizing magnetic elements 906 on a single axis the coils 804 that activate the magnetic elements 906 positioned in a single plane perpendicular to that axis are energized in a sequential manner. To change the axis of rotation other magnetic elements 906 are energized perpendicular to the desired axis of rotation. Hall Effect sensors 806 placed at each coil 804 to determine the axis of orientation and rotational speed of the magnetic array housing 900.

Figure 11:
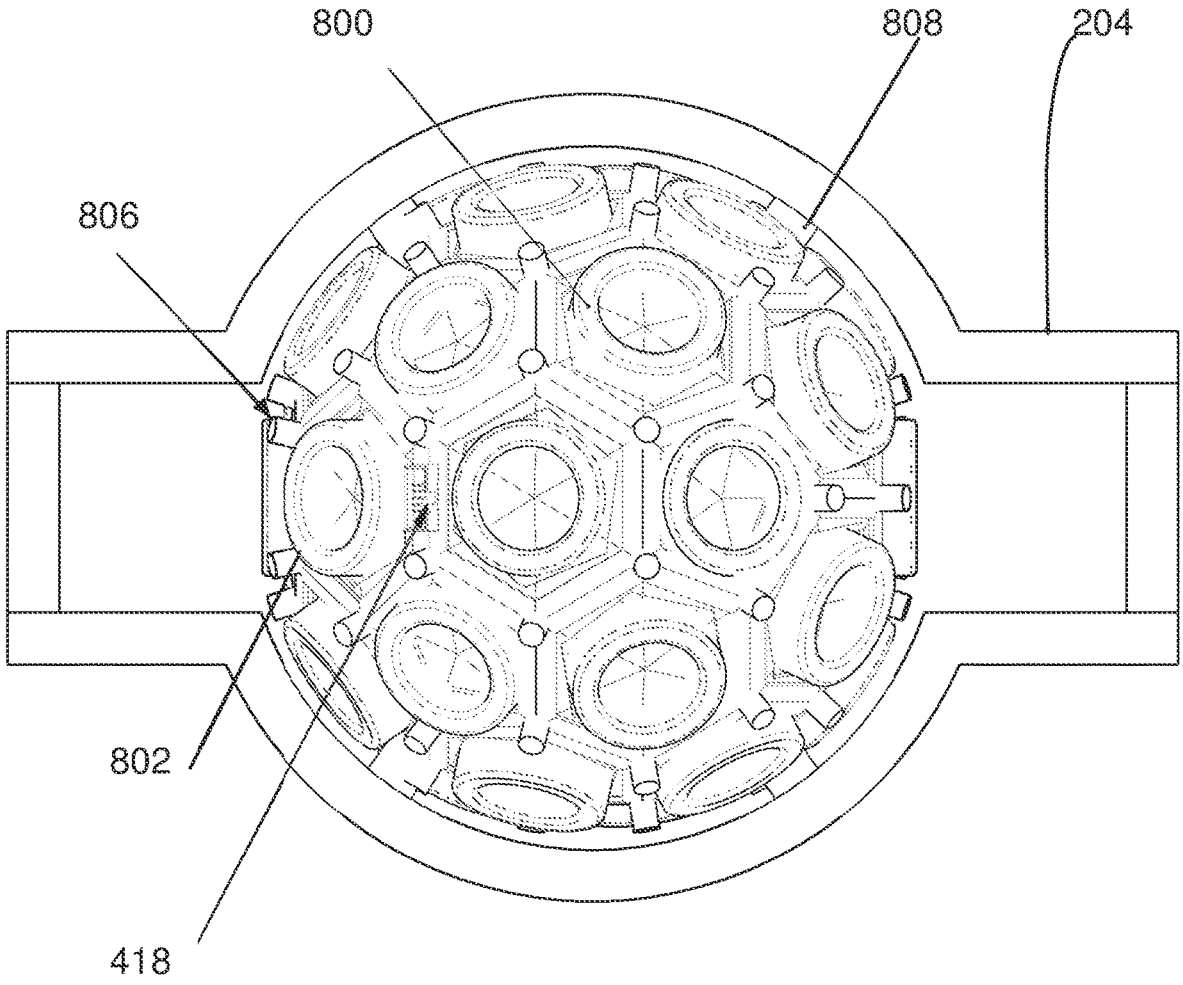
FIG. 11 is another front view of the outer surface of the internal structure of the third embodiment showing containing a spherical magnetic array gyroscope attached to a mounting structure.

With reference to FIG. 11, the embodiment of FIGS. 10-15 has a stabilizing structure 204 that is attached to the coil array housing 802 by mounts 808. The stabilizing structure 204 provides mounting of the magnetic array assembly 800 into the outer shell 102 of the exercise device 100. A controller 210 is located internal to the shell 102. A connection point 418 on the magnetic array assembly 800 provides wired communication to the controller 210. Due to the complex operation modes of this embodiment an external wireless controller 220 is used to enable the exercise device 100. In FIGS. 10-12 all of the coils 804 and hall effect sensors 806 are wired to the connector 418 that is the main connection point to the internal controller 210. The hall effect sensors 806 are positioned between the coils 804 and close to the magnetic array assembly 800 in order to sense the magnitude of a magnetic field generated. The Hall effect sensors 806 are also much closer to the magnets than the coils to primarily sense the magnets in the magnetic array assembly 800. As the magnetic array assembly 800 rotates the sensors 806 sense the position and rotation speed of the magnetic array assembly 900.

Figure 16:
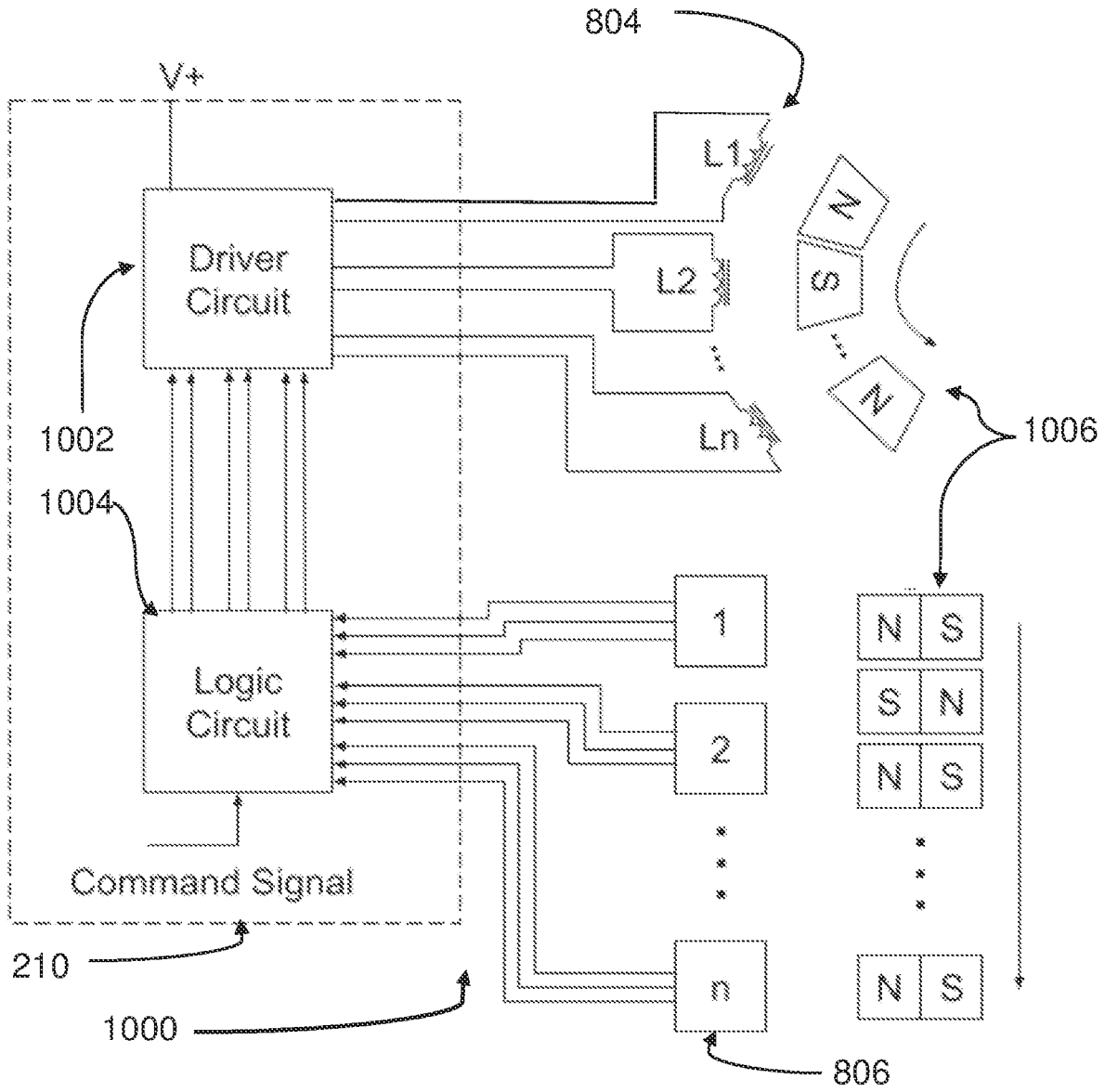
FIG. 16 is a schematic diagram illustrating an electrical arrangement for controlling the operation of the third embodiment shown in FIGS. 10-15.

FIGS. 16 and 17 are schematic diagrams of the wiring connecting the various controllers, motors and rotational components within the embodiments of the exercise devices 100.

FIG. 16 is a schematic diagram 1000 showing the electrical components and connections for the magnetic array embodiment indicating the internal controller 210 which includes a driver circuit 1002 and a logic circuit 1004. The driver circuit 1002 powers the electromagnet coils 804 arrangement). The Hall effect sensors 806 generate a signal based on the magnetic field sensed from the electromagnets, that signal being fed to the logic circuit 1004, thus providing a closed loop feed-back system. The controller 210 receives a command signal from the external wireless controller 220 to move, the logic circuit 1004 processes the command along with the input of the hall effect sensors 806 that sense the position and rotational speed of magnet array assembly 900. The driver circuit 1002 then engages the coils 804 which create an electromagnet and a magnetic field that pushes the magnetic elements 906 in the magnetic array housing 900 causing the magnet array housing 900 to rotate and/or change axial orientation. As shown in FIGS. 13-15 the spherical mass 902, which is made of a lighter material, for example a plastic resin, has a lesser density than the magnetic elements 906 and the disc mass 904. This arrangement creates a preferred stable axis of rotation that is perpendicular to the magnetic elements 906 and disc mass 904, creating the same effect as a rotating flywheel. The disc mass 904 is preferable made of a ferrite material. The coils 804 arranged equally spaced around the coil array housing can thus move the magnet array housing 900 in a way that changes its preferred stable axis of rotation and dynamically changes the preferred axis of rotation to create the perceived force vector.

Based on the teachings herein, one skilled in the art will recognize that a similar exercise device with a single axis of rotation can be constructed using permanent magnetic elements 906 or a combination of electromagnets and permanent magnets can be utilized to generate a hybrid device. The devices described herein can easily be miniaturized and the method of using the devices and different methods of inducing localized magnetic fields can also be employed.

The previous description of the disclosed embodiments is provided to enable any person skilled in the art to make or use the present invention. Based on the description herein various modifications to these embodiments will be readily apparent to those skilled in the art, and the generic principles defined herein can be applied to other embodiments without departing from the spirit or scope of the invention. Thus, the present invention is not intended to be limited to the embodiments shown herein but is to be accorded the widest scope consistent with the principles and novel features disclosed herein.

We claim:

1. A portable, handheld exercise device comprising:

a. a spherical outer shell with an outer surface having multiple parallel handles mounted to or integral with the outer surface thereof, b. an inner shell within the spherical outer shell and spaced therefrom but attached the spherical outer shell, c. a gyroscopic energy-generating structure (GEGS) within the inner shell, said GEGS comprising a rotating disc or a rotating mass configured to simulate a rotating disc, 1) the rotating disc or the rotating mass being configured to spin around a rotational axis orientated in a preselected orientation to the multiple parallel handles, 2) The rotation of the GEGS configured to be powered by an electrical battery positioned within the inner shell, 3) a plurality of spinning characteristics of the rotating disc or the rotating mass configured to be selected by an internal controller communicating with one or more selector switches on the outer surface of the exercise device and/or configured to be selected by a remote controller through a wireless or wired connection, wherein the GEGS comprises:

a. an outer ring within the inner shell, the outer ring mounted to an inner portion of the outer shell, b. an inner ring within the outer ring, the inner ring configured to rotate multiple 360° revolutions within the outer ring around a first shaft, said first shaft attaching the inner ring to the outer ring, and c. a mounting bracket attached to, and rotational within the inner ring around a second shaft, said second shaft perpendicular to the first shaft, d. the rotating disc comprising a disc-shaped flywheel, said flywheel mounted to a motor, said motor configured to cause the flywheel to rotate, the motor attached to the mounting bracket within the inner ring, the combination of the rotation of the outer ring, the inner ring and the mounting bracket around their respective shafts resulting in the orientation of the flywheel being adjustable in relationship to the multiple parallel handles mounted to or integral with the outer surface of the spherical outer shell.

2. The portable, handheld exercise device of claim 1 wherein the plurality of spinning characteristics of the rotating disc or the rotating mass comprise rotational speed and orientation of the rotational axis.

3. The portable, handheld exercise device of claim 1 further including the remote controller for controlling the plurality of spinning characteristics of the rotating disc and the rotation of the inner ring and the outer ring.

4. The portable, handheld exercise device of claim 1 further comprising a power supply jack configured to connect to an external power source.

5. The portable, handheld exercise device of claim 1 wherein the multiple parallel handles are configured to be removable.

6. The portable, handheld exercise device of claim 1 further comprising D-rings on the outer surface.

7. The portable, handheld exercise device of claim 1 wherein the internal controller comprises a driver circuit and a logic circuit.

8. A portable, handheld exercise device comprising:

an outer shell with an outer surface having a plurality of handles connected to the outer surface thereof, an inner shell attached to and within the outer shell, said inner shell being spaced from the outer shell, a gyroscopic energy-generating structure (GEGS) within the inner shell, said GEGS comprising a disc-shaped flywheel configured to spin around a rotational axis, wherein the GEGS is configured to be powered by an electrical battery, wherein a plurality of spinning characteristics of the rotating disc are configured to be selected by an internal controller or a remote controller, and wherein the GEGS comprises:

an outer ring within the inner shell, the outer ring mounted to an inner portion of the outer shell, an inner ring within the outer ring, the inner ring configured to rotate multiple 360° revolutions within the outer ring around a first shaft, said first shaft attaching the inner ring to the outer ring, and a mounting bracket attached to, and rotational within the inner ring around a second shaft, said second shaft being perpendicular to the first shaft, said flywheel mounted to a motor, said motor configured to cause the flywheel to rotate, the motor attached to the mounting bracket within the inner ring, the combination of the rotation of the outer ring, the inner ring, and the mounting bracket around their respective shafts resulting in the orientation of the flywheel being adjustable in relationship to the plurality of handles.

9. The portable, handheld exercise device of claim 8, wherein the handles are removable.

10. The portable, handheld exercise device of claim 8, wherein the outer shell is spherical.

11. The portable, handheld exercise device of claim 8, further comprising the internal controller.

12. The portable, handheld exercise device of claim 11, wherein the internal controller comprises a driver circuit and a logic circuit.

13. The portable, handheld exercise device of claim 11, wherein the internal controller is housed within the inner shell.

* * * * *